United States Patent [19]

Meisner et al.

[11] Patent Number: 4,695,061

[45] Date of Patent: Sep. 22, 1987

[54] VALVE STEM SEAL

[75] Inventors: Edward O. Meisner, Elkhart, Ind.; Charles F. Romine, Madison, Conn.

[73] Assignee: Eagle-Picher Industries, Inc., Cincinnati, Ohio

[21] Appl. No.: 770,782

[22] Filed: Aug. 29, 1985

[51] Int. Cl.[4] ..... F01L 3/08; F16J 15/32

[52] U.S. Cl. ..... 277/27; 123/188 P; 251/214; 277/152; 277/208

[58] Field of Search ..... 251/214; 277/208.12, 277/207 R, 152, 153, 212 C, 212 F, 212 R, 27; 123/188 P

[56] References Cited

U.S. PATENT DOCUMENTS

| | | | |
|---|---|---|---|
| 2,542,141 | 2/1951 | Horton | 277/153 |
| 2,821,973 | 2/1958 | Guhman . | |
| 3,038,347 | 6/1962 | Sloan et al. | 251/214 X |
| 3,333,578 | 8/1967 | Muller | 123/188 P |
| 3,373,998 | 3/1968 | Bialkowski | 277/110 |
| 3,443,814 | 5/1969 | Dahlheimer | 277/152 X |
| 3,498,621 | 3/1970 | Wilson | 277/152 |
| 3,601,420 | 8/1971 | Binford | 277/212 |
| 4,125,265 | 11/1978 | Grzesiak | 277/152 |
| 4,325,558 | 4/1982 | Poggio | 251/214 X |
| 4,449,718 | 5/1984 | Muller | 277/152 X |
| 4,560,177 | 12/1985 | Riley, Jr. | 277/152 X |

FOREIGN PATENT DOCUMENTS

| | | | |
|---|---|---|---|
| 2352992 | 5/1974 | Fed. Rep. of Germany | 277/153 |
| 562664 | 5/1957 | Italy | 277/153 |
| 96316 | 7/1980 | Japan | 123/188 P |
| 539154 | 12/1976 | U.S.S.R. | 123/188 P |

OTHER PUBLICATIONS

Society of Automotive Engineers, Inc., Jan. 1982, vol. 90, No. 1, pp. 75-78, "Valve Stem Seals Handle Oil Metering and Wear", based on SAE paper 810292 by Ing. grad Hans Deuring, Goertze AG, West Germany.

*Primary Examiner*—Allan N. Shoap

*Attorney, Agent, or Firm*—Wood, Herron & Evans

[57] ABSTRACT

The seal for a valve stem wherein a sleeve-like seal has alternating grooves and lands surrounding the valve stem. The lands have frustoconical surfaces, the opposed surfaces on each land having different angular relationships to the axis of the valve stem to promote the flow of lubricating oil in the desired direction.

3 Claims, 4 Drawing Figures

VALVE STEM SEAL

This invention relates to a valve stem seal.

In an internal combustion engine are valves employed to control the flow of combustion and exhaust gases to and from the cylinders within the engine. The valves have valve stems which are slidably mounted in valve guides. Cams or rocker arms cause the valve stems to reciprocate in their respective guides.

It has been necessary to introduce lubrication between the surfaces of the valve stem and guide, respectively. To this end, a pool of oil surrounds the valve stems in an enclosed chamber. A controlled amount is permitted to flow into the valve guide and provide the necessary lubrication. If too much oil passes through the valve guide, it burns in the combustion chamber, fouling the plugs and using a lot of oil. If too little flows to the valve guides, the valve stems overheat and bind on the guides.

It has been the practice to provide an elastomeric valve stem seal between the guide and the reservoir of oil to control the passage of limited amounts of lubricating oil to the guide. The seal is usually in the form of a sleeve fixed to the guide and having an internal surface engaging the valve stem. The internal surface has been formed as an internal thread creating a helical groove through which oil may slowly move from the oil reservoir toward the guide. The groove permits only a limited control of the flow of oil.

An objective of the invention has been to provide a valve stem seal which more directly controls the flow of lubricant and provides for greater flow at higher speeds of the engine, since the valves, operating at higher speeds, require greater lubrication.

Another objective of the invention has been to provide a new concept of the design of the valve stem seal, one which permits the seal to be designed to the engine and its lubrication requirements.

To this end the invention introduces the concept of hydrodynamically controlling oil flow. This is accomplished by providing a seal whose internal surface is formed of concentric alternating lands and grooves, the lands engaging the valve stems.

Each of the lands has frustoconical surfaces facing the oil reservoir and valve guides, respectively. These frustoconical surfaces of the lands are angulated with respect to the axis of the valve stems to encourage flow of oil toward the guide.

More specifically, the frustoconical surfaces on both sides of each land lie at an acute angle to the surface of the valve stem. The angle of the surface at the oil side is smaller than the angle of the surface at the guide side. As the valve stem reciprocates, it carries oil on its surface and drives it against the frustoconical surface. The hydrodynamic force of the oil on the frustoconical surfaces has a vector operating on the land radially away from the stem. Since the surface facing the oil reservoir has a smaller angle with respect to the valve stem than the opposing surface, the radial vector will be greater for that surface. Therefore, each land tends to be forced a greater distance away from the valve stem on the stroke of the valve stem toward the valve guide than in the opposite direction of stroke. This difference tends to promote the flow of oil toward the guide.

It is desired to keep oil between adjacent lands. Therefore, the frustoconical surface on the guide side of each land lies at an acute angle to the axis of the valve stem, but that angle is greater than the angle on the oil side. Thus, on the stroke of the valve stem toward the oil side, some flow is promoted away from the guide. On reciprocation alternating in both directions, oil moves both ways, but the sum of the movements of the oil is toward the guide because of the difference in the angular relationship of the frustoconical surface of the lands.

As the engine is operated with higher speeds, the force vectors are proportionally greater and, hence, a greater amount of oil is encouraged to flow toward the valve guide.

Given the concept of the present invention, it is possible to design valve stem seals to the requirements of particular engines by varying the angles as well as the number of lands in a particular seal.

The several features and objectives of the present invention will become more readily apparent from the following detailed description taken in conjunction with the accompanying drawings in which.

Figure 1:
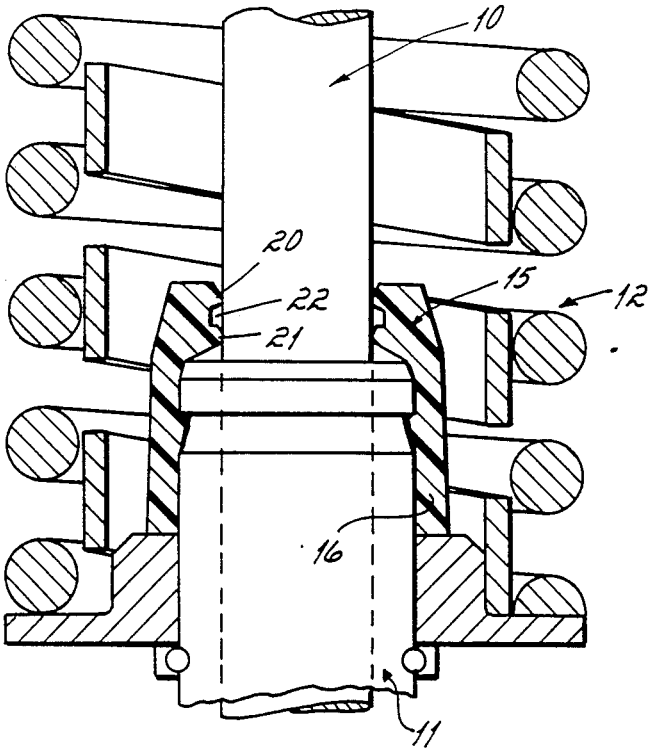
FIG. 1 is a fragmentary view partly in section of a valve stem, a seal and a valve guide.

Referring to FIG. 1, a valve stem is shown at 10, the valve stem reciprocating in a guide 11. The inside diameter of the guide and the outside diameter of the stem are such as to provide a small clearance between the two, thereby permitting oil to flow between the respective surfaces of the stem and guide, respectively. A known compression spring assembly 12 acts upon the valve to urge it in an upward direction, as shown in FIG. 1. The valve stem is driven in a downward direction by cams or cam-driven rocker arms (not shown), in a conventional manner.

A pool or reservoir of oil surrounds all of the valve stems for the valves employed in an engine.

The valve stem seal is indicated at 15. It is an elastomer such as the fluorelastomer Viton manufactured by duPont.

The valve stem seal 15 is in the form of a sleeve. The lower portion of the sleeve 16 snugly engages the outer surface of the guide 11 to seal it against the flow of oil.

The upper portion of the seal has two lands 20 and 21 which engage the valve stem with an interference fit. In a typical example, the diameter of the valve stem may be 7.96 mm and the inside diameter of the lands may be 7.60 mm, thereby providing an 0.18 mm interference. The lands 20, 21 create a groove 22 between them. The land 20 has a frustoconical surface 25 on the oil side of the land, the surface 25 lying at a 20° angle to the axis of the valve stem. The land 20 has a frustoconical surface 26 on the guide side, the surface 26 lying at a 60° angle to the axis of the valve stem.

The land 21 has a frustoconical surface 28 facing the oil, the surface lying at a 30° angle to the axis of the valve stem. The land 21 has a frustoconical surface 29 facing the guide and lying at an angle 60° to the axis of the valve stem.

Figure 3:
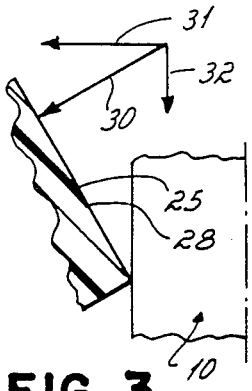
FIG. 3 is a diagrammatic view illustrating vectorially a small angle of the frustoconical surface.

As the valve stem reciprocates in the oil, it carries oil on its surface which bears against the lands 20 and 21. On a down stroke of the valve stem, that is, moving toward the guide, the oil thrust by the valve stem against the frustoconical surfaces 25 and 28 of the lands 20 and 21, respectively, applies its force in a direction 30 perpendicular to the surface 25 and 28 as shown in FIG. 3. That vector has a radial component 31 which is substantially greater than the axial component 32. The radial component tends to lift the land away from the valve stem 10.

Figure 4:
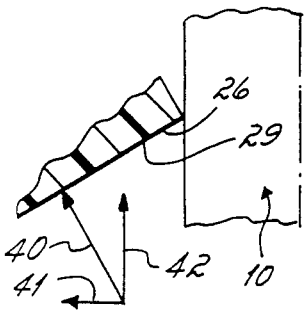
FIG. 4 is a diagrammatic view illustrating vectorially a larger angle of the frustoconical surface.
Figure 2:
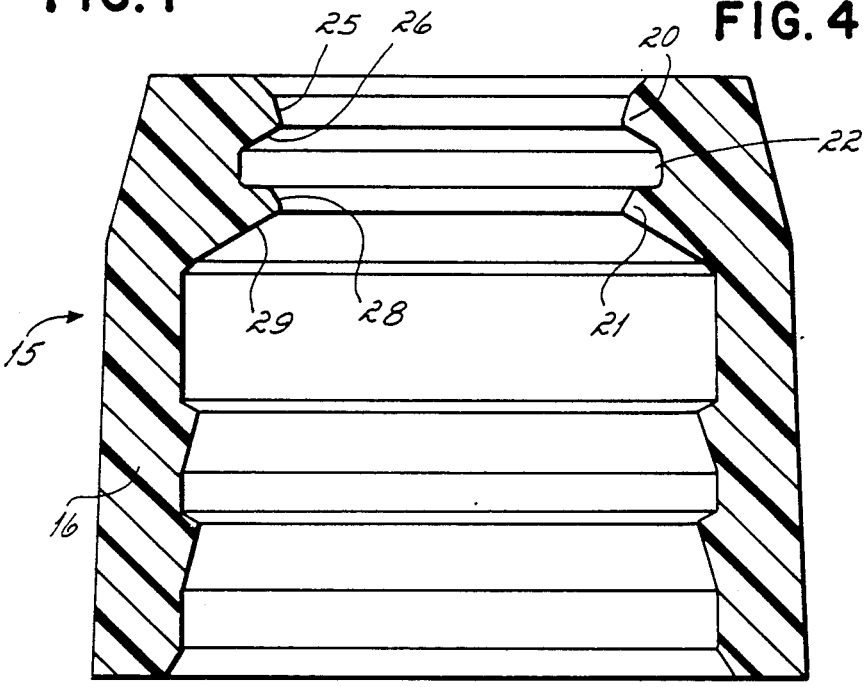
FIG. 2 is a cross-sectional view through the center of a representative valve stem seal.

In the reverse direction, as depicted in FIG. 4, the oil has a force vector 40 bearing against the guide side frustoconical surfaces 26, 29. Since these surfaces lie at an angle of 60° to the axis of the valve stem 10, the radial component of force 41 is not so great as the axial component 42. The radial component 41 during the stroke of the valve stem away from the valve guide is also significantly smaller than the radial component 31 during the stroke of the valve stem toward the valve guide on the opposite land surface. Thus, while there is a tendency of the radial component to lift the lands 20, 21, this lift force is not so great during the stroke of the valve stem away from the valve guide as the lift force during the stroke of the valve stem toward the valve guide.

Since there is a greater hydrodynamic effect of the oil urging the lands away from the stem when the valve stem moves toward the valve guide, oil will be promoted to flow toward the valve guide upon repeated reciprocation of the valve stem.

It can be seen that by varying the angular relationships, the volume of flow toward the valve guide can be varied. As long as it is desired to have the flow toward the valve guide, the angle between the stem and surface 25 should be smaller than the angle between the stem and surface 26 so that the component of lifting force is always greater on the oil side of the seal.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

What is claimed is:

1. For a valve stem having an oil side and a valve guide side, a valve stem seal between said oil and said guide, said seal comprising:

an elastomeric sleeve surrounding said stem and guide, said sleeve having a lower portion surrounding said guide in sealing relation thereto, said sleeve having on the internal surface thereof at least one land tightly engaging the surface of said stem, said land having a first frustoconical surface on the oil side thereof, said land having a second frustoconical surface on the guide side thereof, the angle between said second frustoconical surface and said valve stem being greater than the angle of said first frustoconical surface and said valve stem, whereby the sum of the oil flows caused by reciprocation of the valve stem results in an overall oil flow toward said guide due to said angle between said first frustoconical surface and said valve stem creating a greater hydrodynamic lift-off during the stroke of said valve stem toward said guide than the hydrodynamic lift-off created by said angle between said second frustoconical surface and said valve stem during the stroke of said valve stem away from said guide.

2. A valve stem seal as in claim 1 in which, the angle between said first frustoconical surface and said valve stem is about 30° and the angle between said second frustoconical surface and said valve stem is about 60°.

3. For a valve stem having an oil side and a valve guide side, a valve stem seal between said oil and said guide, said seal comprising:

an elastomeric sleeve surrounding said stem and guide, said sleeve having a lower portion surrounding said guide in sealing relation thereto, said sleeve having on the internal surface thereof at least one land tightly engaging the surface of said stem, each said land having a first frustoconical surface on the oil side thereof, each said land having a second frustoconical surface on the guide side thereof, the angle between said second frustoconical surface and said valve stem being greater than the angle of said first frustoconical surface and said valve stem, whereby the sum of the oil flows caused by reciprocation of the valve stem results in an overall oil flow toward said guide due to said angle between said first frustoconical surface and said valve stem creating a greater hydrodynamic lift-off during the stroke of said valve stem toward said guide than the hydrodynamic lift-off created by said angle between said second frustoconical surface and said valve stem during the stroke of said valve stem away from said guide.

* * * * *